US011268358B2

(12) United States Patent
Jabari et al.

(10) Patent No.: US 11,268,358 B2
(45) Date of Patent: Mar. 8, 2022

(54) DOWNHOLE COMPLETION ASSEMBLIES AND METHODS OF COMPLETING A HYDROCARBON WELL

(71) Applicant: ExxonMobil Upstream Research Company, Spring, TX (US)

(72) Inventors: Rami Jabari, Houston, TX (US); P. Matthew Spiecker, Manvel, TX (US); Michael C. Romer, The Woodlands, TX (US); Michael T. Hecker, Tomball, TX (US); Timothy J. Hall, Pinehurst, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 17/087,708

(22) Filed: Nov. 3, 2020

(65) Prior Publication Data

US 2021/0189845 A1 Jun. 24, 2021

Related U.S. Application Data

(60) Provisional application No. 62/951,322, filed on Dec. 20, 2019.

(51) Int. Cl.

| | |
|---|---|
| ***E21B 43/117*** | (2006.01) |
| ***E21B 43/119*** | (2006.01) |
| ***E21B 43/14*** | (2006.01) |
| *E21B 47/13* | (2012.01) |

(52) U.S. Cl.
CPC ..... *E21B 43/117* (2013.01); *E21B 43/1195* (2013.01); *E21B 43/14* (2013.01); *E21B 47/13* (2020.05)

(58) Field of Classification Search
CPC .... E21B 43/117; E21B 43/1195; E21B 43/14; E21B 47/13
See application file for complete search history.

(56) References Cited

U.S. PATENT DOCUMENTS 6,957,701 B2 * 10/2005 Tolman ..... E21B 17/203 166/120
2019/0301262 A1 * 10/2019 Hamid ..... E21B 29/00

* cited by examiner

*Primary Examiner* — Yong-Suk (Philip) Ro
(74) *Attorney, Agent, or Firm* — Leandro Arechederra, III

(57) ABSTRACT

Methods include positioning a downhole completion assembly in a tubular conduit of a downhole tubular of a hydrocarbon well. The downhole completion assembly includes a downhole sub-assembly and an uphole sub-assembly. The methods also include forming a fluid seal within the tubular conduit with the downhole sub-assembly, decoupling the uphole sub-assembly from the downhole sub-assembly, translating the uphole sub-assembly in an uphole direction, perforating the downhole tubular with the uphole sub-assembly, translating the uphole sub-assembly in a downhole direction, coupling the uphole sub-assembly to the downhole sub-assembly, ceasing the fluid seal, and translating the downhole completion assembly in the uphole direction.

15 Claims, 7 Drawing Sheets

DOWNHOLE COMPLETION ASSEMBLIES AND METHODS OF COMPLETING A HYDROCARBON WELL

CROSS-REFERENCE TO RELATED APPLICATIONS

This application claims the benefit of U.S. Provisional Application 62/951,322, filed Dec. 20, 2019, the entirety of which is herein incorporated by reference.

FIELD OF THE INVENTION

The present disclosure relates generally to downhole completion assemblies and methods of completing a hydrocarbon well.

BACKGROUND OF THE INVENTION

Conventional completion operations for hydrocarbon wells utilize a plurality of conventional plugs to fluidly isolate a plurality of spaced-apart stimulation zones from one another during the stimulation process. More specifically, the conventional completion operations generally utilize a first conventional plug, which is positioned within a tubular conduit of a downhole tubular of the hydrocarbon well, to form a first fluid seal within the tubular conduit. The conventional completion operations then perforate and pressurize an uphole region of the downhole tubular, thereby producing fractures within the subterranean formation. A second conventional plug, which is positioned uphole from a first perforated region of the downhole tubular, then is utilized to form a second fluid seal within the tubular conduit. The perforate-pressurize-seal process is repeated a plurality of times to stimulate the plurality of spaced-apart stimulation zones; and, subsequent to the conventional completion operations, the tubular conduit includes a plurality of spaced-apart conventional plugs that must be removed to permit production from the hydrocarbon well.

Some conventional completion operations may utilize soluble conventional plugs that are designed to dissolve after a period of time in contact with wellbore fluids. Some conventional completion operations may utilize a milling device to mill the conventional plugs from the tubular conduit. While effective under certain circumstances, these mechanisms for removal of conventional plugs may be time-consuming, costly, and/or unreliable. Thus, there exists a need for improved downhole completion assemblies and methods of completing a hydrocarbon well.

SUMMARY OF THE INVENTION

Downhole completion assemblies and methods for completing a hydrocarbon well are disclosed herein. The downhole completion assemblies are configured to be utilized during a completion operation of a hydrocarbon well and/or to be positioned within a tubular conduit of a downhole tubular that extends within a wellbore of the hydrocarbon well. The downhole completion assemblies include an uphole sub-assembly. The uphole sub-assembly may define an uphole end of the downhole completion assembly and/or may include a perforation device. The downhole completion assemblies also include a downhole sub-assembly. The downhole sub-assembly may define a downhole end of the downhole completion assembly and/or may include a sealing structure that is configured to form a fluid seal within the tubular conduit. The downhole completion assemblies also include a coupler. The coupler may be configured to selectively and repeatedly couple and decouple the uphole sub-assembly and the downhole sub-assembly to one another.

The methods include positioning a downhole completion assembly within a target region of a tubular conduit of a downhole tubular of a hydrocarbon well. The downhole completion assembly includes an uphole sub-assembly and a downhole sub-assembly. The methods also include forming a fluid seal within the tubular conduit, such as with a sealing structure of the downhole sub-assembly, and decoupling the downhole sub-assembly from the uphole sub-assembly. The methods further include operatively translating the uphole sub-assembly in an uphole direction within the tubular conduit, perforating the downhole tubular, such as with a perforation device of the uphole sub-assembly, and operatively translating the uphole sub-assembly in a downhole direction within the tubular conduit. The methods also include coupling the uphole sub-assembly to the downhole sub-assembly, ceasing the fluid seal, and operatively translating the downhole completion assembly in the uphole direction within the tubular conduit.

DETAILED DESCRIPTION OF THE INVENTION

Figure 1:
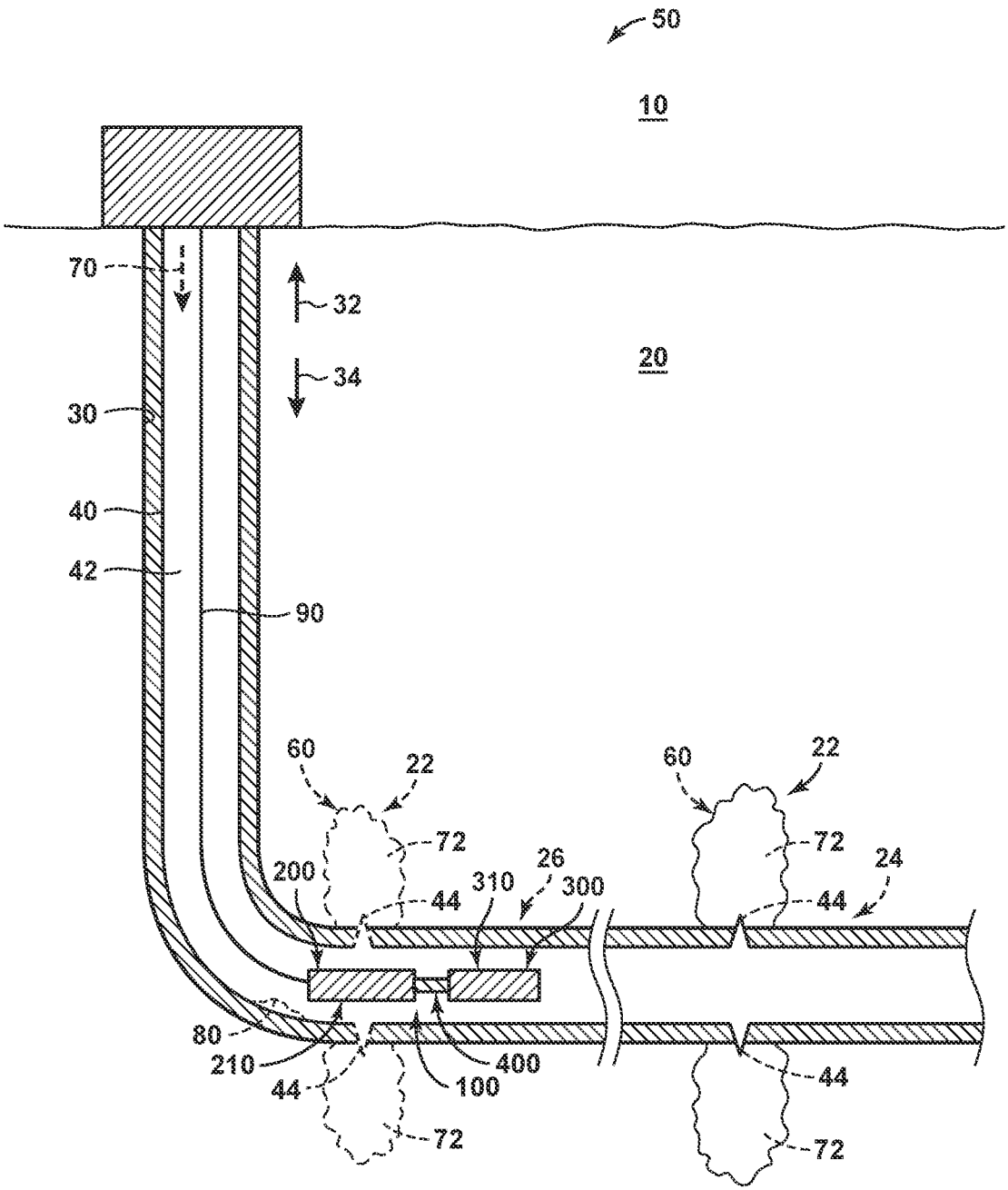
FIG. 1 is a schematic illustration of examples of a hydrocarbon well in which downhole completion assemblies may be utilized, according to the present disclosure, and that may be utilized to perform methods, according to the present disclosure.

FIGS. 1-16 provide examples of hydrocarbon wells 50, downhole completion assemblies 100 and/or methods 500, according to the present disclosure. Elements that serve a similar, or at least substantially similar, purpose are labeled with like numbers in each of FIGS. 1-16, and these elements may not be discussed in detail herein with reference to each of FIGS. 1-16. Similarly, all elements may not be labeled in each of FIGS. 1-16, but reference numerals associated therewith may be utilized herein for consistency. Elements, components, and/or features that are discussed herein with reference to one or more of FIGS. 1-16 may be included in and/or utilized with any of FIGS. 1-16 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic representation of examples of a hydrocarbon well 50 in which downhole completion assembly 100 may be utilized, according to the present disclosure, and/or that may be utilized to perform methods 500, according to the present disclosure. As illustrated in FIG. 1, hydrocarbon well 50 includes a wellbore 30 that extends within a subsurface region 20. Wellbore 30 also may be referred to herein as extending between a surface region 10 and subsurface region 20. Hydrocarbon well 50 also includes a downhole tubular 40 that extends within wellbore 30 and defines a tubular conduit 42. Hydrocarbon well 50, and/or wellbore 30 thereof, defines an uphole direction 32, such as may be directed along a length of the wellbore and towards surface region 10, and a downhole direction 34, such as may be directed along the length of the wellbore and away from the surface region. In the present disclosure, a first structure may be referred to as being uphole from a second structure. In this context, the first structure and the second structure may be located within wellbore 30 and/or the first structure may be in uphole direction 32 from, or relative to, the second structure, as measured along the length of the wellbore. Similarly, a third structure may be referred to as being downhole from a fourth structure. In this context the third structure and the fourth structure may be located within wellbore 30 and/or the third structure may be in a downhole direction 34 from, or relative to, the fourth structure, as measured along the length of the of the wellbore.

As shown in FIG. 1, hydrocarbon well 50 includes downhole completion assembly 100. Downhole completion assembly 100 may be configured to be positioned within tubular conduit 42 of hydrocarbon well 50 and utilized during a completion operation of hydrocarbon well 50. As illustrated in solid lines in FIG. 1, downhole completion assembly 100 includes an uphole sub-assembly 200 that may define an uphole end of the downhole completion assembly and/or that may include a perforation device 210. Perforation device 210 may be utilized to form one or more perforations 44 in downhole tubular 40 during completion of hydrocarbon well 50. Downhole completion assembly 100 also includes a downhole sub-assembly 300 that may define a downhole end of downhole completion assembly 100 and/or that may include a sealing structure 310 that may be configured to form a fluid seal within tubular conduit 42 and/or with downhole tubular 40. Downhole completion assembly 100 further includes a coupler 400 that may be configured to selectively and/or repeatedly couple uphole sub-assembly 200 and downhole sub-assembly 300 to one another and/or to permit the uphole sub-assembly and the downhole sub-assembly to be selectively and/or operatively decoupled from one another. Stated another way, coupler 400 may permit selective coupling (and recoupling) of uphole sub-assembly 200 to downhole sub-assembly 300 and/or decoupling of the uphole sub-assembly from the downhole sub-assembly during the completion operation that are performed on and/or within hydrocarbon well 50.

Figure 4:
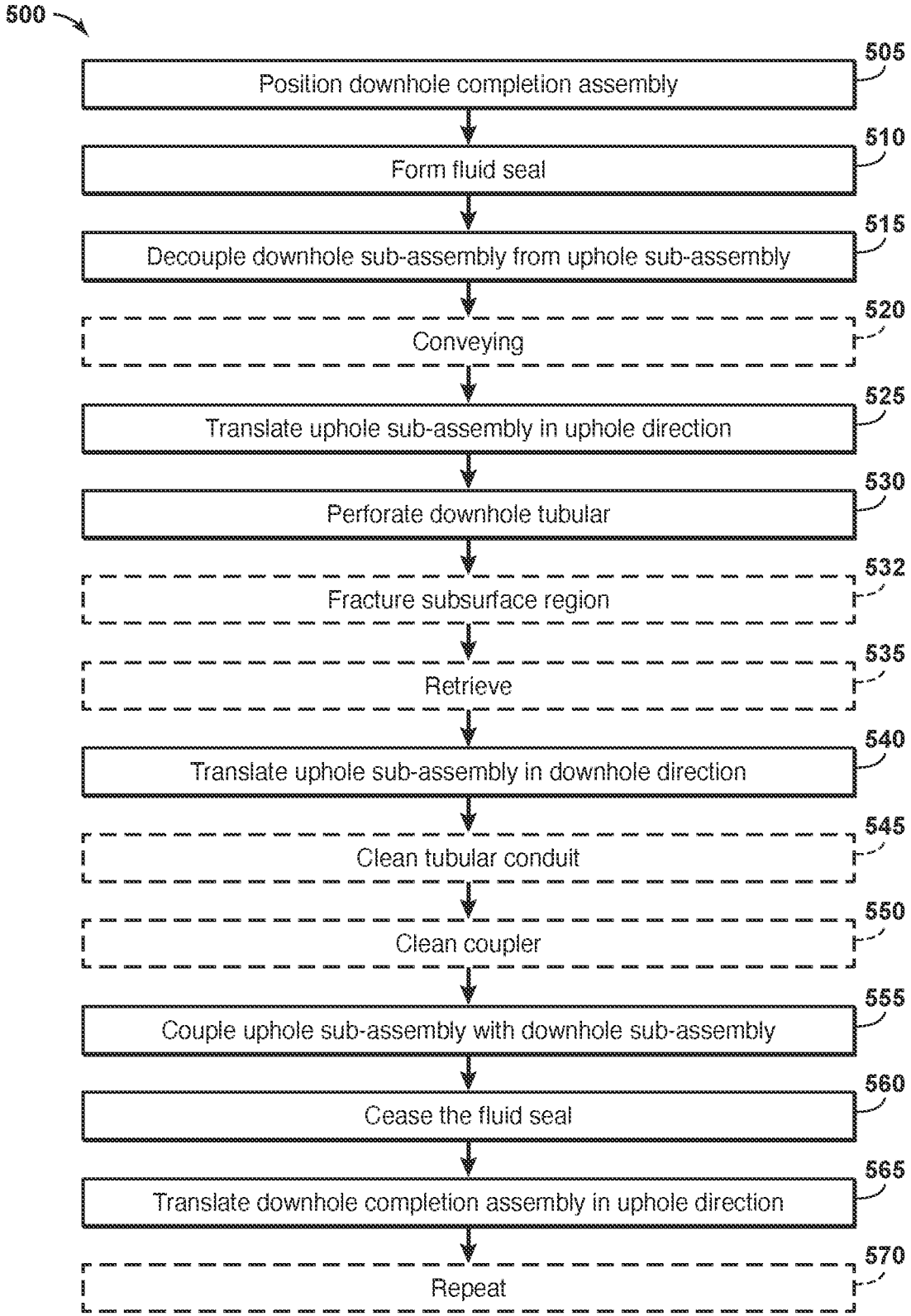
FIG. 4 is a flow chart illustrating examples of methods of completing a hydrocarbon well, according to the present disclosure.

As illustrated collectively by FIGS. 1 and 5-16 and discussed in more detail herein with reference to methods 500 of FIG. 4, during operation of hydrocarbon well 50 and/or when completion operations are performed on hydrocarbon well 50, downhole completion assembly 100 may be operatively positioned within one or more target regions of tubular conduit 42. For example, downhole completion assembly 100 initially may be positioned within a first, or a downhole, target region 24. While the downhole completion assembly is positioned within the target region of the tubular conduit, sealing structure 310 of downhole sub-assembly 300 may form the fluid seal within tubular conduit 42, and uphole sub-assembly 200 may be decoupled from downhole sub-assembly 300 by selectively decoupling coupler 400. In some examples, following the decoupling, uphole sub-assembly 200 may be translated in uphole direction 32, and perforation device 210 of uphole sub-assembly 200 may be utilized to form one or more perforations 44 in a target zone 22 of downhole tubular 40 of hydrocarbon well 50.

As indicated in dashed lines at 44 in FIG. 1, subsequent to the perforating, downhole sub-assembly 300 and uphole sub-assembly 200 may be recoupled, the fluid seal formed by downhole sub-assembly 300 may be ceased, and downhole completion assembly 100 may be translated to a second, or uphole, target region 26, which is uphole of downhole target region 24, to form a second set of perforations 44. Thus, in some examples, downhole completion assembly 100 may be utilized to perforate a plurality of spaced-apart regions of downhole tubular 40, without requiring removal of downhole completion assembly 100 from downhole tubular 40 and/or by utilizing only a single sealing structure 310 that progressively moves in uphole direction 32 as the completion operation progresses along the length of the wellbore. As discussed herein, target zone 22 may refer to a particular region of downhole tubular 40 that is targeted for perforation. A particular target region, such as uphole target region 26 and downhole target region 24, may refer to a region of downhole tubular 40 in which downhole completion assembly 100 is to be positioned during the completion operations.

In some examples, an umbilical 90 may be operatively attached to uphole sub-assembly 200. Umbilical 90 may extend within tubular conduit 42 from uphole sub-assembly 200 to surface region 10 and/or may be configured to provide a motive force to move uphole sub-assembly 200 and/or downhole completion assembly 100 in the uphole direction. Examples of the umbilical include coiled tubing, a workover pipe, a wireline, and/or a slick line. Umbilical 90 may provide a physical, or a mechanical, connection between surface region 10 and uphole sub-assembly 200 and/or between surface region 10 and downhole completion assembly 100. Additionally or alternatively, umbilical 90 may be configured to convey electrical power, and/or one or more data signals, to the wellbore, to downhole completion assembly 100, and/or to uphole sub-assembly 200.

Figure 2:
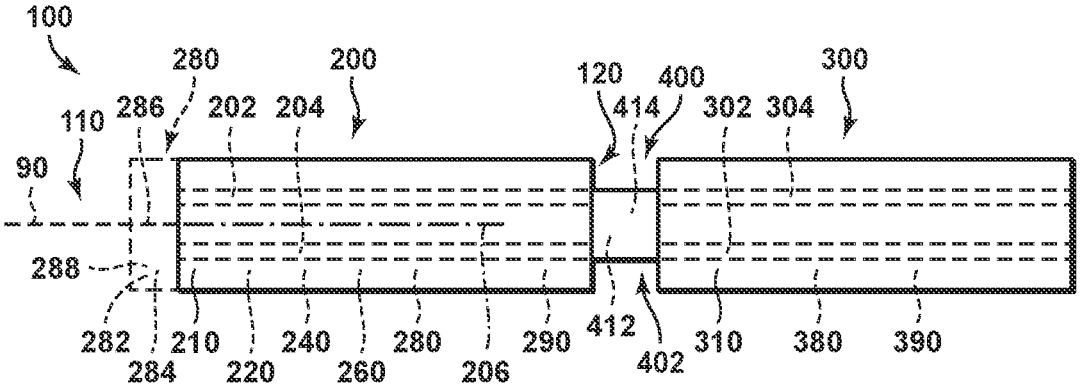
FIG. 2 is a schematic illustration of examples of downhole completion assemblies, according to the present disclosure.
Figure 3:
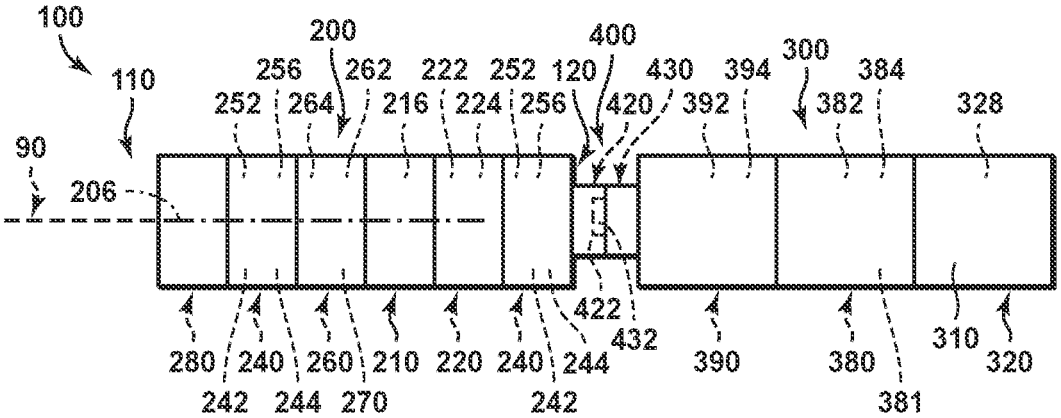
FIG. 3 is a schematic illustration of examples of downhole completion assemblies, according to the present disclosure.

In some examples, umbilical 90 may be permanently attached to uphole sub-assembly 200 and/or may be configured to remain attached to uphole sub-assembly 200 during the completion operations. In some examples, umbilical 90 may be configured to selectively detach from, and reattach with, uphole sub-assembly 200 during the completion operations. As illustrated in FIGS. 2-3, uphole sub-assembly 200 may include an attachment module 280 that may be configured to be selectively and operatively attached with, detached from, and/or reattached with umbilical 90.

FIGS. 2 and 3 schematically illustrate examples of downhole completion assemblies 100. Downhole completion assemblies 100 illustrated in FIGS. 2-3 may include and/or be more detailed schematic illustrations of downhole completion assemblies 100 of FIGS. 1 and 5-16. With this in mind, any of the structures, functions, and/or features that are disclosed herein with reference to downhole completion assemblies 100 of FIGS. 2-3 may be included in and/or utilized with downhole completion assemblies 100 of FIGS. 1 and 5-16 without departing from the scope of the present disclosure. Similarly, any of the structures, functions, and/or features that are disclosed herein with reference to downhole completion assemblies 100 of FIGS. 1 and 5-16 may be included in and/or utilized with downhole completion assemblies 100 of FIGS. 2-3 without departing from the scope of the present disclosure.

As shown in the examples of FIGS. 2-3, attachment module 280 may be positioned on an uphole end 110 of uphole sub-assembly 200. Attachment module 280 may be configured to selectively and operatively provide one or more of a mechanical connection, an electrical power connection, and/or a data signal connection between umbilical 90 and uphole sub-assembly 200. More specifically, in some examples, attachment module 280 may include a mechanical connector 288 that may be configured to selectively and operatively attach with, detach from, and reattach with umbilical 90. Mechanical connector 288 may be configured to be operatively transitioned between a coupled state, in which mechanical connector 288 interlocks with umbilical 90, and a decoupled state, in which mechanical connector permits relative motion between umbilical 90 and uphole sub-assembly 200.

Mechanical connector 288 may include any suitable structure for operatively and selectively connecting umbilical 90 and uphole sub-assembly 200. For example, mechanical connector 288 may include a latch that is configured to selectively and operatively attach mechanical connector 288 to umbilical 90. In some examples, attachment module 280 further may include a swivel 286 that is operatively coupled between mechanical connector 288 and uphole sub-assembly 200 and may be configured to permit uphole sub-assembly 200 to rotate relative to umbilical 90 when mechanical connector 288 is coupled to umbilical 90.

With continued reference to FIG. 2, in some examples, attachment module 280 may include one or more electrical contacts. As an example, attachment module 280 may include an attachment power contact 282 and/or an attachment data contact 284. Attachment power contact 282 and attachment data contact 284 collectively may be referred to herein as attachment module electrical contacts, as contacts, as contacts 282, 284, and/or as electrical contacts 282, 284. Electrical contacts 282, 284 may be configured to convey an electric current between umbilical 90 and uphole sub-assembly 200. More specifically, attachment power contact 282 may be configured to convey electrical power between a power conduit of umbilical 90 and uphole sub-assembly 200. Attachment data contact 284 may be configured to convey one or more data signals, such as electrical data signals, between a data conduit of umbilical 90 and uphole sub-assembly 200. Attachment power contact 282 and attachment data contact 284 may define separate or distinct electrical connections. Alternatively, attachment power contact 282 and attachment data contact 284 may define a single connection. For example, when attachment power contact 282 and attachment data contact 284 form a single connection, electrical power may be conveyed through the single connection as a direct current, and data signals may be conveyed through the single connection in an intermittent, varying, and/or alternating current, which may be overlaid, or superimposed, on the direct current.

Attachment power contact 282 and attachment data contact 284 may include any suitable structures for providing electrical power and/or one or more data signals between uphole sub-assembly 200 and umbilical 90. As discussed herein with reference to mechanical connector 288, attachment power contact 282, and/or attachment data contact 284, may be configured to be selectively attached with, detached from, and reattached with a respective conduit of umbilical 90.

As further shown in FIG. 2, uphole sub-assembly 200 may include one or more uphole sub-assembly conduits that may be configured to conduct an electric current along a length of the uphole sub-assembly. As more specific examples, uphole sub-assembly 200 may include an uphole sub-assembly power conduit 202 that may extend along the length of uphole sub-assembly 200 and/or may be configured to convey electrical power from the uphole end of uphole sub-assembly 200 and toward and/or to coupler 400. Uphole sub-assembly 200 additionally or alternatively may include an uphole sub-assembly data conduit 204 that may extend along the length of the uphole sub-assembly and/or that may be configured to convey a data signal from the uphole end of uphole sub-assembly and toward and/or to coupler 400. Uphole sub-assembly power conduit 202 and attachment module data conduit 204 collectively may be referred to herein as uphole sub-assembly conduits, as conduits, as conduits 202, 204, and/or as electrical conduits 202, 204. While FIG. 2 illustrates uphole sub-assembly conduits 202, 204 being discrete conduits and/or as defining distinct bodies, in some examples, uphole sub-assembly power conduit 202 and uphole sub-assembly data conduit 204 form a single conduit and/or may be defined by a single body.

Uphole sub-assembly conduits 202, 204 may be electrically connected to electrical contacts 282, 284 of attachment module 280. For example, uphole sub-assembly power conduit 202 may be connected, or electrically connected, to attachment power contact 282. As another example, uphole sub-assembly data conduit 204 may be connected, or electrically connected, to attachment power contact 282. The uphole sub-assembly conduit(s) additionally or alternatively may be electrically connected to coupler 400. In such examples, uphole sub-assembly power conduit 202 and/or uphole sub-assembly data conduit 204 may be described as being configured to conduct power and/or data between umbilical 90 and coupler 400.

Figure 7:
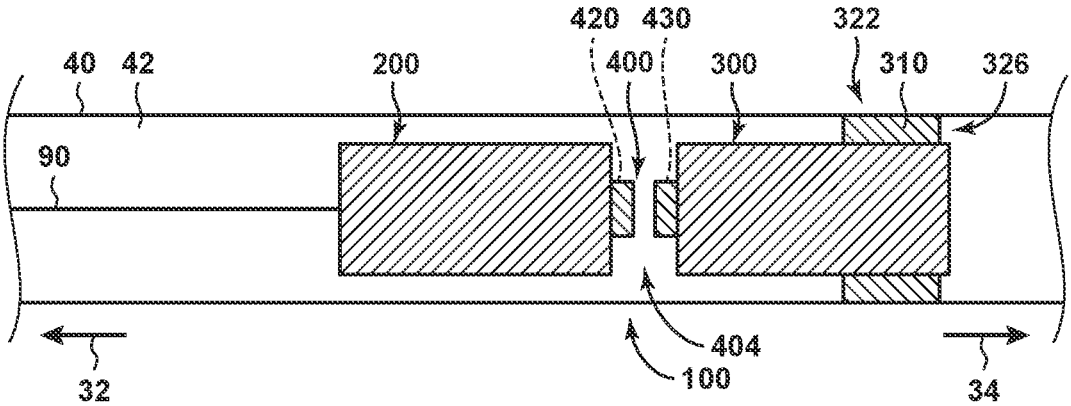
FIG. 7 is a schematic illustration of examples of a portion of the methods of FIG. 4.

Coupler 400 may include any suitable structure, and/or combination of sub-structures, such that coupler 400 may provide selective and operative coupling between uphole sub-assembly 200 and downhole sub-assembly 300. Coupler 400 may be configured to be selectively transitioned between a coupled state 402, an example of which is shown in FIG. 2, and a decoupled state 404, an example of which is shown in FIG. 7. When coupler 400 defines the coupled state, coupler 400 may interlock uphole sub-assembly 200 and downhole sub-assembly 300 to one another. In the coupled state, uphole sub-assembly 200 and downhole sub-assembly 300 optionally may rotate relative to one another, but the uphole sub-assembly 200 and downhole sub-assembly 300 are constrained to be moved together in uphole and downhole directions within the wellbore. When coupler 400 defines the decoupled state, coupler 400 may permit relative uphole and/or downhole motion between uphole sub-assembly 200 and downhole sub-assembly 300. As an example, coupler 400 may include a latching mechanism that may be configured to retain coupler 400 in the coupled state and selectively release or disengage to transition coupler 400 to the decoupled state.

As illustrated in FIG. 3, coupler 400 may include an uphole coupler portion 420 that is operatively attached to uphole sub-assembly 200 and a downhole coupler portion 430 that is operatively attached to downhole sub-assembly 300. Uphole coupler portion 420 may be configured to operatively engage with downhole coupler portion 430 to selectively and repeatedly couple uphole sub-assembly 200 and downhole sub-assembly 300 with one another. As examples, uphole coupler portion 420 may include a recessed region 422 that is configured to selectively and operatively receive a projecting region 432 of downhole coupler portion 430. In such examples, recessed region 422 and projecting region 432 may be described as providing a mechanical link between downhole coupler portion 430 and uphole coupler portion 420 when coupler 400 is in the coupled state. Recessed region 422 may include one or more pass-through channels that may be configured to permit debris to exit the recessed region 422, for example while downhole completion assembly 100 is being translated through and/or being positioned within tubular conduit 42.

Referring back to FIG. 2, coupler 400 further may include one or more electrical connectors that may be configured to convey an electric current between uphole sub-assembly 200 and downhole sub-assembly 300. As more specific examples, the electrical connector(s) of coupler 400 may include an electrical power connector 412 that is configured to conduct electrical power from uphole sub-assembly 200 to downhole sub-assembly 300, and/or may include an electrical data connector 414 that is configured to convey one or more data signals from uphole sub-assembly 200 to downhole sub-assembly 300. Electrical power connector 412 and electrical data connector 414 collectively may be referred to herein as electrical connectors, electrical connectors 412, 414, and/or as connectors 412, 414. Electrical connectors 412, 414 may be electrically connected with uphole sub-assembly conduits 202, 204. For example, electrical power connector 412 may be electrically connected to uphole sub-assembly power conduit 202, and electrical data connector 414 may be electrically connected to uphole sub-assembly data conduit 204. As discussed in more detail herein with reference to electrical contacts 282, 284 of attachment module 280, electrical power connector 412 and electrical data connector 414 may define separate connections or may define a single connection.

In some examples, electrical connectors 412, 414 include a downhole portion that is operatively coupled to downhole sub-assembly 300 and an uphole portion that is operatively coupled to uphole sub-assembly 200. In such examples, the uphole portion of electrical connectors 412, 414 may be configured to be operatively and selectively interconnected with, decoupled from, and recoupled with the downhole portion of electrical connectors 412, 414.

Electrical connectors 412, 414 also may be electrically connected with one or more downhole sub-assembly conduits that may be configured to conduct an electric current along at least a portion of a length of downhole sub-assembly 300. As shown in the examples of FIG. 2, downhole sub-assembly conduits may include a downhole sub-assembly power conduit 302 that may extend along at least a portion of the length of the downhole sub-assembly 300 and/or may be configured to convey electrical power from coupler 400 to at least one other component of downhole sub-assembly 300. Downhole sub-assembly 300 additionally or alternatively may include a downhole sub-assembly data conduit 304 that may extend along at least a portion of the length of downhole sub-assembly 300 and/or that may be configured to convey one or more data signals from coupler 400 to at least one other component of downhole sub-assembly 300. Downhole sub-assembly power conduit 302 and downhole sub-assembly data conduit 304 collectively may be referred downhole sub-assembly conduits, downhole sub-assembly electrical conduits, downhole sub-assembly conduits 302, 304, and/or downhole sub-assembly electrical conduits 302, 304. As discussed in more detail herein with reference to the uphole sub-assembly conduits, downhole sub-assembly power conduit 302 and/or downhole sub-assembly data conduit 304 may define a single conduit or may define separate conduits.

FIGS. 2 and 3 further schematically illustrate examples of components, modules, and/or devices that may be included in downhole completion assembly 100 and/or that may be electrically connected with one or more of the electrical components of downhole completion assembly 100 that are discussed herein with reference to FIG. 2. With initial focus on uphole sub-assembly 200, uphole sub-assembly 200 includes perforation device 210, which may be configured to perforate the downhole tubular of the hydrocarbon well. Thus, as discussed herein, uphole sub-assembly 200 also may be referred to as a perforation sub-assembly. In some examples, perforation device 210 may be configured to form a single perforation in the downhole tubular of hydrocarbon well 50. Additionally or alternatively, perforation device 210 may be configured to form a plurality of perforations in the downhole tubular. In such examples, perforation device 210 may be configured to form the plurality of perforations in the downhole tubular without removal of uphole sub-assembly 200 from the tubular conduit. As examples, perforation device 210 may include a perforation gun. Additionally or alternatively, perforation device 210 may include a shaped-charge perforation device, which may include a plurality of shaped charges.

In some examples, and as illustrated in FIG. 3, uphole sub-assembly power conduit 202 and/or uphole sub-assembly data conduit 204 may include a perforation device electrical conductor 216. Perforation device electrical conductor 216 may extend between the uphole and downhole ends of perforation device 210 and/or may be configured to convey one or more data signals and/or electrical power to perforation device 210 and/or downhole from the perforation device. For example, perforation device electrical conductor 216 may be configured to convey a data signal to perforation device 210 to selectively detonate one or more shaped charges included in perforation device 210. Additionally or alternatively, perforation device electrical conductor 216 may be configured to selectively conduct electrical power to one or more shaped charges included in perforation device 210, such as to selectively detonate the one or more shaped charges.

As discussed in more detail with reference to FIG. 4, methods 500 include translating uphole sub-assembly 200 and/or downhole completion assembly 100 in the uphole and the downhole directions within tubular conduit 42. Translating uphole sub-assembly 200 in the uphole direction may be achieved, for example, utilizing umbilical 90. Translating uphole sub-assembly 200 in the downhole direction may be achieved, for example, by pumping a conveyance fluid within wellbore. However, in some examples, it may be desirable for uphole sub-assembly 200 to include a mechanism for operatively translating uphole sub-assembly 200 to precise locations within the tubular conduit without utilizing an external motive force, and/or for operatively translating the uphole sub-assembly in circumstances in which umbilical 90 and/or the conveyance fluid may be ineffective.

In view of the above, and as illustrated in FIGS. 2-3, uphole sub-assembly 200 may include a conveyance module 260. As shown in FIG. 3, in some examples, conveyance module 260 may be positioned within uphole sub-assembly 200 uphole of perforation device 210 and downhole of a cleaner module 240 and/or attachment module 280. The conveyance module, when present, may be configured to provide a motive force to operatively translate uphole sub-assembly 200 and/or downhole completion assembly 100 within the hydrocarbon well. Conveyance module 260 may be configured to operatively translate uphole sub-assembly 200 and/or downhole completion assembly 100 in the uphole direction and/or the downhole direction in any suitable manner and/or utilizing any suitable structure.

Conveyance module may be powered by any suitable source or mechanism, such as with conveyance module being an electrically powered conveyance module or a hydraulically powered conveyance module. As an example, conveyance module 260 may include a conveyance motor 270 that may be configured to provide the motive force for facilitating operative translation of uphole sub-assembly 200. In some examples, conveyance module 260 and/or conveyance motor 270 may be electrically powered. In such examples, conveyance module may include one or more conveyance module electrical contacts, such as a conveyance module power contact 262 that is configured to convey electrical power from umbilical 90 and/or uphole sub-assembly power conduit 202 to conveyance module 260, such as to power conveyance module 260. Conveyance module 260 also may include a conveyance module data contact 264 that is configured to convey one or more data signals from umbilical 90 and/or uphole sub-assembly data conduit 204 to conveyance module 260, such as to permit control of conveyance module 260 from the surface region. Conveyance module power contact 262 and/or conveyance module data contact 264 may be electrically connected to uphole sub-assembly conduits 202, 204. Additionally or alternatively, conveyance module power contact 262 and/or conveyance module data contact 264 may be electrically connected to attachment module 280. Conveyance module electrical contacts 262, 264 may define a single contact or may define distinct contacts.

Conveyance module 260 may include one or more conveyance structures for urging uphole sub-assembly 200 and/or downhole completion assembly 100 in a desired direction of translation. Examples of the conveyance structures include a tractor, a propeller, an impeller, and/or a fluid jet. In some examples, conveyance module 260 may be configured to operatively engage with the downhole tubular to operatively translate uphole sub-assembly 200 and/or downhole completion assembly 100 within the tubular conduit.

Referring back to FIG. 1, when downhole completion assembly 100 and/or uphole sub-assembly 200 is positioned within hydrocarbon well 50, downhole completion assembly 100 and/or uphole sub-assembly 200 may encounter debris 80 within downhole tubular 40. In some examples, debris 80 may inhibit translation of downhole completion assembly 100 and/or uphole sub-assembly 200 within hydrocarbon well 50. With this in mind, and as schematically shown in FIGS. 2 and 3, uphole sub-assembly 200 also may include cleaner module 240 that may be configured to agitate and/or move debris within the hydrocarbon well. For example, cleaner module 240 may agitate debris 80 to move debris 80 out of a path of downhole completion assembly 100 and/or uphole sub-assembly 200 as downhole completion assembly 100 and/or uphole sub-assembly 200 is translated through the downhole tubular.

Cleaner module 240 may include any suitable structure for agitating debris within the downhole tubular. For example, as schematically illustrated in FIG. 3, cleaner module 240 may include one or more cleaning elements 256 and a motor 252 for operatively actuating cleaning elements 256. As a specific example, the one or more cleaning elements 256 may include one or more rotating brushes that may be configured to rotate about longitudinal axis 206 of uphole sub-assembly 200 and agitate debris 80 responsive to receipt of rotary power from motor 252.

In some examples, cleaner module 240 and/or motor 252 may be electrically powered. Cleaner module 240 may include one or more cleaner module electrical contacts, such as a cleaner module power contact 242 that may be configured to convey electrical power to cleaner module 240 from umbilical 90 and/or uphole sub-assembly power conduit 202. The cleaner module additionally or alternatively may include a cleaner module data contact 244 that may be configured to convey one or more data signals from umbilical 90 and/or from uphole sub-assembly data conduit 204 to the cleaner module, such as to permit control of cleaner module 240 from the surface region.

With continued reference to FIG. 3, cleaner module 240 may be positioned proximate to uphole end 110 of uphole sub-assembly 200 and/or proximate to attachment module 280. Additionally or alternatively, cleaner module 240 may be positioned proximate to a downhole end 120 of uphole sub-assembly 200. As a more specific example, cleaner module 240 may include an uphole cleaner module 240 positioned proximate to the uphole end of uphole sub-assembly 200 and a downhole cleaner module 240 positioned proximate to the downhole end of uphole sub-assembly 200. In such a configuration, each of the uphole and downhole cleaner modules may include at least one independently operated cleaning element 256, such as a rotating brush. In such examples, the uphole cleaner module may be utilized to agitate debris within the downhole tubular while downhole completion assembly 100 and/or uphole sub-assembly 200 is being translated in the uphole direction. In some examples, the downhole cleaner module may be utilized to agitate debris within the downhole tubular while downhole completion assembly 100 and/or uphole sub-assembly 200 is being translated in the downhole direction.

As shown in FIGS. 2 and 3, uphole sub-assembly 200 further may include a pump module 220 that may be configured to pump debris away from proximate to, and/or in the path of, downhole completion assembly 100 and/or uphole sub-assembly 200 within the hydrocarbon well. When downhole completion assembly 100 and/or uphole sub-assembly 200 are translated in a particular direction within hydrocarbon well 50, uphole sub-assembly 200 may be described as having a leading end that is oriented towards the direction of translation and a trailing end that is oriented away from the direction of translation. Pump module 220 may be configured to pump the debris toward the trailing end of uphole sub-assembly 200 and/or downhole completion assembly 100 during translation of uphole sub-assembly 200 and/or downhole completion assembly 100.

As a more specific example, the trailing end may correspond to the downhole end of uphole sub-assembly 200 during translation of uphole sub-assembly 200 in the uphole direction, and the trailing end may correspond to the uphole end of uphole sub-assembly 200 during translation of uphole sub-assembly 200 in the downhole direction. With this in mind, pump module 220 may include and/or be a reversible pump that may be configured to selectively switch a pumping direction of the debris. As an example, the reversible pump may be configured to selectively pump debris in the downhole direction when uphole sub-assembly 200 and/or downhole completion assembly 100 is translated in the uphole direction and/or to pump debris in the uphole direction when uphole sub-assembly 200 and/or downhole completion assembly 100 is translated in the downhole direction.

In some examples, pump module 220 may pump debris that have been agitated by cleaner module 240. Thus, as illustrated in FIG. 3, pump module 220 may be positioned within uphole sub-assembly 200 uphole of the downhole cleaner module 240 and downhole of the uphole cleaner module 240. Positioning pump module 220 between the uphole and downhole cleaner modules 240 may enhance pumping of agitated debris towards the trailing end of uphole sub-assembly 200, when uphole sub-assembly is translated in either of the uphole and downhole directions.

Pump module 220 may be electrically powered and may include one or more pump module electrical contacts. As examples, pump module 220 may include a pump module power contact 222 and/or a pump module data contact 224, which may include similar electrical connectivity and/or serve similar purposes as those discussed in more detail herein with reference to the conveyance module electrical contacts and the cleaner module electrical contacts.

Shifting focus to downhole sub-assembly 300, downhole sub-assembly 300 may include a sealing module 320 that may include sealing structure 310 configured to form a fluid seal within the tubular conduit of the hydrocarbon well. Sealing structure 310 also may be described as being configured to selectively and operatively form a plug in the tubular conduit. Thus, as discussed herein, downhole sub-assembly 300 also may be referred to as a sealing sub-assembly, a plug sub-assembly, and/or an isolation sub-assembly. Sealing module 320 may be configured to selectively and operatively transition sealing structure 310 between a disengaged state, in which the downhole sub-assembly 300 is free to move within the tubular conduit, and an engaged state, in which sealing structure 310 operatively engages the downhole tubular and forms the fluid seal within the tubular conduit. In some examples, sealing structure 310 includes a resilient sealing body 328, and sealing structure 310 is configured to selectively compress resilient sealing body 328 against the downhole tubular to form the fluid seal within the tubular conduit.

With continued reference to FIGS. 2 and 3, downhole sub-assembly 300 may include a power module 380 that may be configured to power at least one other component of the downhole sub-assembly. For example, power module 380 may be configured to power sealing structure 310, such as to facilitate transitioning sealing structure 310 between the disengaged state and the engaged state. In some examples, power module 380 may receive power from and/or may be charged by power received from umbilical 90 via coupler 400. Power module 380 may be configured to power the at least one other component of the downhole sub-assembly while electrically connected to umbilical 90 through coupler 400 and uphole sub-assembly 200 and/or while disconnected from umbilical 90. For example, power module 380 may include a power storage structure 381 for storing power received from one or more sources. As examples, power storage structure 381 may include at least one battery, capacitor, and/or supercapacitor for storing and selectively distributing electrical power. As another example, power module 380 may include an energy harvesting structure that may be configured to supply power to power module 380 and/or power storage structure 381, without the need for charging and/or powering from umbilical 90.

In some examples, power module 380 may include one or more power module electrical contacts that may be electrically connected to coupler 400 and/or may be electrically connected to the downhole sub-assembly conduits. More specifically, power module 380 may include a power module data contact 384 that may be configured to convey one or more data signals to power module 380 and/or a power module power contact 382 that may be configured to convey electrical power to power module 380.

Downhole sub-assembly 300 further may include a downhole sub-assembly communication module 390 that may be configured to communicate with at least one other component of the hydrocarbon well. In some examples, downhole sub-assembly communication module 390 may be configured to receive data signals from a surface region, such as via umbilical 90. In some examples, downhole sub-assembly communication module 390 may include a communication module power contact 392 and/or a communication module data contact 394 that may be electrically connected to coupler 400 and/or to the downhole sub-assembly conduits.

As illustrated in FIG. 2, in some examples, uphole sub-assembly 200 also may include an uphole sub-assembly communication module 290. In such a configuration, the communication modules of the uphole and downhole sub-assemblies may be configured to transfer wireless data signals remotely and/or to define a downhole wireless network. In such examples, the uphole and downhole sub-assembly communication modules may be configured to transfer data signals between the uphole sub-assembly and the downhole sub-assembly when the uphole and downhole sub-assemblies are not connected by coupler 400 and instead are positioned in separate, or spaced-apart, locations within the downhole tubular.

Downhole sub-assembly communication module 390 also may be electrically connected to at least one other component and/or module included in the downhole sub-assembly, such as to actuate the component and/or module responsive to a data signal received from at least one other component of the hydrocarbon well. As an example, sealing module 320 may be configured to selectively actuate transitioning of sealing structure 310 between the engaged state and the disengaged state responsive to receipt of a transition data signal from downhole sub-assembly communication module 390. In some examples, downhole sub-assembly 300 may be configured to self-destruct responsive to receipt of self-destruct data signal received by downhole sub-assembly communication module 390. As a more specific example, responsive to receipt of the transition data signal received by downhole sub-assembly communications module 390, sealing module 320 may be configured to actuate transition of sealing structure 310 from the engaged state to the disengaged state to release downhole sub-assembly 300 from the downhole tubular and cause downhole sub-assembly 300 to fall downhole in hydrocarbon well 50 away from the target region of the tubular conduit or be displaced downhole by pumping fluid from surface.

It is within the scope of the present disclosure that at least one component, module, device, and/or sub-assembly of downhole completion assembly 100 discussed herein with reference to FIGS. 2 and 3 may define a modular portion of downhole completion assembly 100. Stated another way, at least one component, module, device, and/or sub-assembly may be configured to be swapped out and/or exchanged independently of the other components, modules, devices, and/or sub-assemblies. Stated in slightly different terms, at least one component, module, device, and/or sub-assembly of downhole completion assembly 100 may be configured to be swapped or exchanged without disassembling the other components, modules, devices, and/or sub-assemblies. For example, as discussed in more detail herein with reference to FIG. 4 and methods 500, a given component, device, and/or module of uphole sub-assembly 200 may be exchanged for a new, or a replacement, respective component, device, or module when uphole sub-assembly 200 is retrieved to the surface region. Likewise, a given component of downhole sub-assembly 300 may be exchanged for a new, or a replacement, respective component, device, and/or module when downhole sub-assembly 300 is retrieved to the surface region. It is further within the scope of the present disclosure that two or more, more than 50%, at least substantially, or even all of the components, modules, devices, and/or sub-assemblies may be so configured. Additionally or alternatively, each of uphole sub-assembly 200 and downhole sub-assembly 300 may be swapped out for a new and/or replacement sub-assembly during methods 500.

FIG. 4 is a flow chart schematically illustrating examples of methods 500 of completing a hydrocarbon well, such as hydrocarbon well 50 of FIG. 1. FIGS. 5-16 are schematic illustrations of examples of portions of methods 500 of FIG. 4 and/or of portions of hydrocarbon wells 50 of FIG. 1. Each step or portion of methods 500 may be performed utilizing the downhole completion assembly, the uphole sub-assembly, the downhole sub-assembly, and/or the portions thereof that are discussed in detail herein with respect to FIGS. 2 and 3.

Methods 500 include positioning a downhole completion assembly at 505, forming a fluid seal at 510, decoupling a downhole sub-assembly of the downhole completion assembly from an uphole sub-assembly of the downhole completion assembly at 515, and translating the uphole sub-assembly in an uphole direction at 525. Methods 500 further include perforating the downhole tubular at 530, translating the uphole sub-assembly in a downhole direction at 540, coupling the uphole sub-assembly with the downhole sub-assembly at 555, ceasing the fluid seal at 560, and translating the downhole completion assembly in the uphole direction at 565. Methods 500 also may include conveying at 520, fracturing at 532, retrieving at 535, cleaning the tubular conduit at 545, cleaning the coupler at 550, and repeating at 570.

Positioning the downhole completion assembly at 505 may include positioning the downhole completion assembly within the tubular conduit and/or within a target, or a desired, region of the tubular conduit. As an example, the positioning at 505 may include flowing the downhole completion assembly in a downhole direction within the tubular conduit. As another example, the positioning at 505 may include utilizing a conveyance module of the downhole completion assembly to provide a motive force to translate the downhole completion assembly in an uphole direction or in the downhole direction. As yet another example, the positioning at 505 may include utilizing an umbilical that may be operatively attached to the downhole completion assembly to pull the downhole completion assembly in the uphole direction.

The positioning at 505 may be performed with any suitable timing and/or sequence during methods 500. As examples, the positioning at 505 may be performed prior to forming the fluid seal at 510 and/or prior to decoupling at 515.

Figure 5:
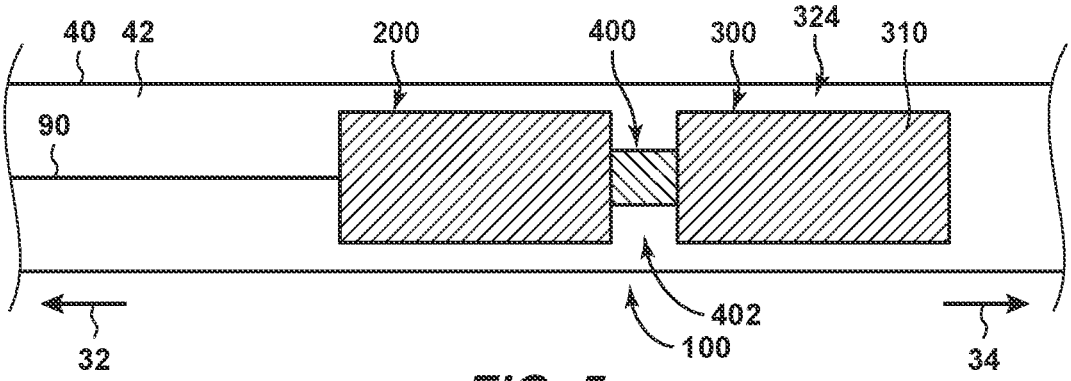
FIG. 5 is a schematic illustration of examples of a portion of the methods of FIG. 4.

An example of the positioning at 505 is illustrated in FIG. 5. As shown, the uphole sub-assembly 200 and downhole sub-assembly 300 may be in a coupled state 402, or operatively coupled via coupler 400 during the positioning at 505. The positioning at 505 may include translating downhole completion assembly 100 in uphole direction 32 within tubular conduit 42 and/or translating downhole completion assembly 100 in downhole direction 34 within tubular conduit 42.

For example, the positioning at 505 may include flowing downhole completion assembly 100 in downhole direction 34 to a first target region and/or a downhole-most target region such as to form a first set of perforations or a downhole-most set of perforations within downhole tubular 40. The positioning at 505 alternatively may include translating downhole completion assembly 100 in uphole direction 32, such as by pulling downhole completion assembly 100 with umbilical 90, which may extend to surface region 10. As an example, translating downhole completion assembly 100 in uphole direction 32 may be performed as a part of the repeating at 570 and/or to form a set of perforations within downhole tubular 40 that are uphole from the downhole-most set of perforations within downhole tubular 40. Stated another way, translating downhole completion assembly 100 in uphole direction 32 may be performed to position downhole completion assembly 100 in a second target region that is uphole of a current target region and/or from the downhole-most target region.

As discussed herein, downhole sub-assembly 300 may include sealing module 320 having a sealing structure 310 that may be configured to form a fluid seal within the tubular conduit of the hydrocarbon well. As shown in the sequence illustrated between FIGS. 5 and 6, sealing structure 310 may be in a disengaged state 324, in which the sealing structure is free to move within the tubular conduit, during the positioning at 505.

Figure 6:
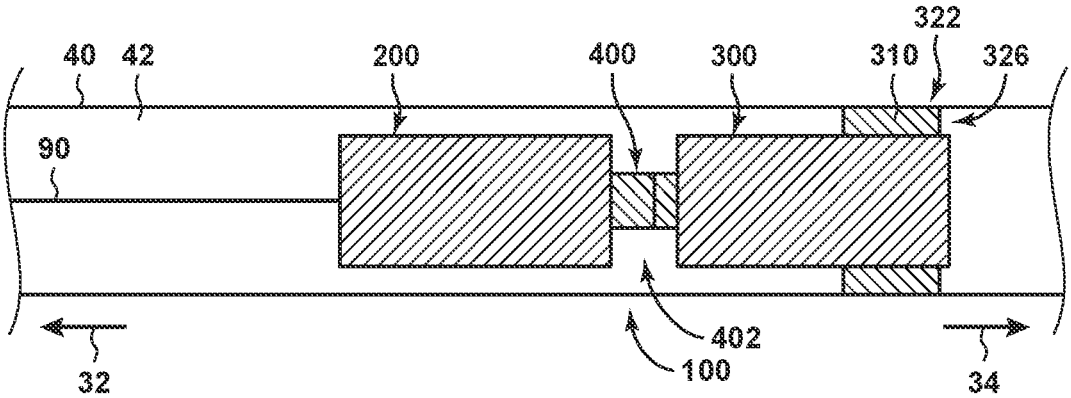
FIG. 6 is a schematic illustration of examples of a portion of the methods of FIG. 4.

Referring back to FIG. 4, methods 500 include forming the fluid seal at 510. As shown in FIG. 6, the forming at 510 may include forming a fluid seal 322 within tubular conduit 42 with sealing structure 310 of downhole sub-assembly 300. Fluid seal 322 may be configured to resist fluid flow past sealing structure 310 within tubular conduit 42, such as to permit pressurization of a region of tubular conduit 42 that is uphole from the downhole sub-assembly with a fracturing fluid. Further shown in the example of FIG. 6, coupler 400 may define coupled state 402 during the forming at 510.

The forming the fluid seal at 510 may include transitioning sealing structure 310 from the disengaged state to an engaged state 326, in which sealing structure 310 forms fluid seal 322 within the tubular conduit. The forming the fluid seal at 510 additionally or alternatively may include operatively engaging sealing structure 310 with downhole tubular 40 to resist motion of downhole sub-assembly 300 within tubular conduit 42. Stated another way, the forming the fluid seal at 510 may include securing downhole sub-assembly 300 within a desired, or target, region of the downhole tubular.

The forming the fluid seal at 510 may be performed at any suitable timing and/or sequence during methods 500. As examples, the forming the fluid seal at 510 may be performed subsequent to the positioning at 505 and/or prior to the decoupling at 515. Subsequent to forming the fluid seal at 510, methods 500 also may include maintaining the fluid seal during one or more other steps or portions of methods 500. As examples, methods 500 may include maintaining the fluid seal during the decoupling at 515, during the translating at 525, during the perforating at 530, during the translating at 540, and/or during the coupling at 555.

As illustrated in FIG. 4, methods 500 include decoupling the downhole sub-assembly from the uphole sub-assembly at 515. The decoupling at 515 may include releasing the uphole sub-assembly from the downhole sub-assembly. As an example, the decoupling at 515 may include decoupling to permit relative motion along a length of the tubular conduit and between the uphole sub-assembly and the downhole sub-assembly. Additionally or alternatively, the decoupling at 515 may include decoupling to permit translating the uphole sub-assembly in the uphole direction at 525.

The decoupling at 515 may be performed with any suitable timing and/or sequence during methods 500. As examples, the decoupling may be performed subsequent to the positioning at 505, subsequent to the forming the fluid seal at 510, and/or prior to the translating at 525.

FIG. 7 illustrates examples of the decoupling at 515. As illustrated in FIG. 7, sealing structure 310 may be in engaged state 326 during the decoupling at 515. Subsequent to the decoupling at 515, coupler 400 of downhole completion assembly 100 may define a decoupled state 404 in which coupler 400 permits relative motion between uphole sub-assembly 200 and downhole sub-assembly 300. Thus, the decoupling at 515 may include transitioning coupler 400 from the coupled state to decoupled state 404.

As discussed herein, in some examples, coupler 400 includes an uphole coupler portion 420 that is operatively attached to uphole sub-assembly 200, and a downhole coupler portion 430 that is operatively attached to downhole sub-assembly 300. In such examples, the decoupling at 515 may include releasing uphole coupler portion 420 from downhole coupler portion 430. As a more specific example, uphole coupler portion 420 and downhole coupler portion 430 may define a coupling mechanism, and the decoupling at 515 may include releasing the coupling mechanism.

Referring again to FIG. 4, methods 500 may include conveying at 520. The conveying at 520 may include communicating a data signal between two or more components of the hydrocarbon well. Additionally or alternatively, the conveying at 520 may include conveying an electrical power between two or more components of the hydrocarbon well. The conveying at 520 may include utilizing any suitable set or combination of the electrical components of the downhole completion assembly that are discussed herein with reference to FIGS. 2 and 3. The conveying at 520 also may be performed with any suitable timing and/or sequence during methods 500.

For example, the conveying at 520 may include conveying an electrical power and/or a data signal between the uphole sub-assembly and the downhole sub-assembly. As discussed herein with reference to FIGS. 2 and 3, coupler 400 may include an electrical connector that is configured to convey an electric current between uphole sub-assembly 200 and downhole sub-assembly 300, and the electrical connector may include an electrical power connector 412 that may be configured to convey electrical power between uphole sub-assembly 200 and downhole sub-assembly 300. In such examples, the conveying at 520 may include powering downhole sub-assembly 300 via electrical power connector 412 prior to the decoupling at 515 and/or subsequent to the coupling at 555. Additionally or alternately, the electrical connector may include electrical data connector 414 that may be configured to communicate a data signal between uphole sub-assembly 200 and downhole sub-assembly 300. In such examples, the conveying at 520 may include communicating a data signal between uphole sub-assembly 200 and downhole sub-assembly 300 via electrical data connector 414 prior to the decoupling at 515 and/or subsequent to the coupling at 555. The conveying at 520 also may include conveying electrical power and/or communicating a data signal between the uphole sub-assembly and the surface region and/or between the downhole sub-assembly and the surface region, such as via umbilical 90.

In some examples, the conveying at 520 may include communicating a data signal wirelessly. For example, the conveying at 520 may include wirelessly communicating a data signal between communication modules of the uphole sub-assembly and the downhole sub-assembly. In such examples, the conveying at 520 may include communicating the data signal between the uphole sub-assembly and the downhole sub-assembly subsequent to the decoupling at 515 and/or prior to the coupling at 555.

A data signal communicated during the conveying at 520 may include information respective to the functioning and/or status of any given component of hydrocarbon well 50. For example, the conveying may include communicating a data signal from the downhole sub-assembly to the uphole sub-assembly and/or to the surface region that includes information respective to a status and/or function of the downhole sub-assembly. As examples, the data signal may include information respective to a seal integrity of the sealing structure, a seal status of the sealing structure, a power status of the downhole completion assembly and/or a coupling status between the uphole sub-assembly and the downhole sub-assembly.

Referring back to FIG. 4, methods 500 include operatively translating the uphole sub-assembly in the uphole direction at 525. The translating at 525 may be performed to position the uphole sub-assembly within the tubular conduit, within a target, or a desired, zone of the tubular conduit, and/or uphole, or farther uphole, from the downhole sub-assembly. The translating at 525 may include translating the uphole sub-assembly in any suitable manner. As an example, the translating at 525 may include operatively translating the uphole sub-assembly in the uphole direction utilizing the umbilical to pull the uphole sub-assembly in the uphole direction. Additionally or alternatively, operatively translating the uphole sub-assembly in the uphole direction may include utilizing the conveyance module of the uphole sub-assembly to provide a motive force to operatively translate the uphole sub-assembly in the uphole direction.

The translating at 525 may be performed with any suitable timing and/or sequence within methods 500. As examples, the translating at 525 may be performed subsequent to the forming the fluid seal at 510, subsequent to the decoupling at 515, and/or prior to perforating at 525.

Figure 8:
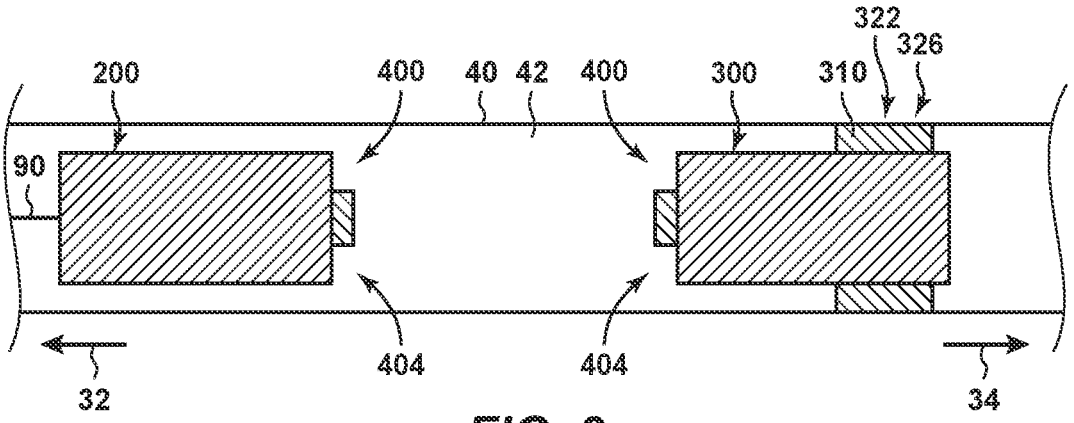
FIG. 8 is a schematic illustration of examples of a portion of the methods of FIG. 4.

FIG. 8 illustrates an example of the translating at 525. As shown, downhole sub-assembly 300 may be in engaged state 326 and/or forming fluid seal 322, and coupler 400 may be in decoupled state 404 during the translating at 525. When coupler 400 is in decoupled state 404, uphole sub-assembly may be free to translate in uphole direction 32, such as by pulling the uphole sub-assembly utilizing umbilical 90.

Turning back to FIG. 4, methods 500 further include perforating the downhole tubular at 530. The perforating at 530 may include forming a single perforation or a plurality of perforations with uphole sub-assembly and/or within a target zone of the downhole tubular. More specifically, the perforating at 530 may include perforating the target zone of the downhole tubular with, via, and/or utilizing the perforation device of the uphole sub-assembly. As discussed herein, the perforation device may include a perforation gun and/or a shaped-charge perforation device. With this in mind, the perforating at 530 also may be described as urging one or more projectiles or charges through a target region of the downhole tubular.

Figure 9:
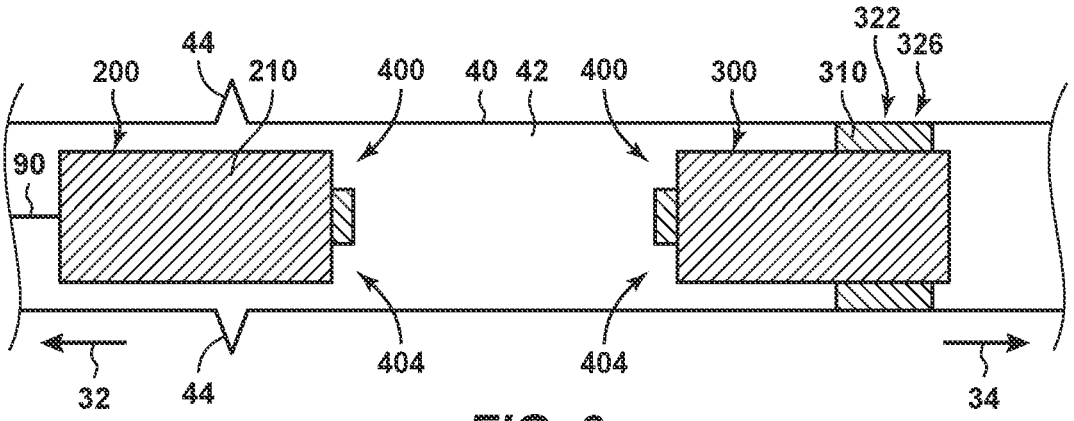
FIG. 9 is a schematic illustration of examples of a portion of the methods of FIG. 4.

FIG. 9 illustrates an example of the perforating at 530. As illustrated therein, perforation device 210 of uphole sub-assembly 200 has been utilized to form one or more perforations 44 within a target region of downhole tubular 40. In the specific example shown, perforations 44 are formed in downhole tubular 40 uphole of downhole sub-assembly 300, such as following the translating at 525.

The perforating at 530 may be performed with any suitable timing and/or sequence within methods 500. As examples, the perforating at 530 may be performed subsequent to the translating at 525, substantially simultaneously with the translating at 525, and/or prior to the translating at 525. For example, methods 500 may include forming one or more perforations and/or at least partially perforating the downhole tubular with the perforation device before and/or while the uphole sub-assembly is translated in the uphole direction at 525.

Referring back to FIG. 1, in some examples, methods 500 include forming a first perforation 44, a first set of perforations 44, and/or a downhole-most set of perforations 44 within a downhole target zone 22. In such examples, methods 500 further may include repeating at 570 the perforating to form a second perforation 44, a second set of perforations 44, and/or an uphole set of perforations 44 within an uphole target zone 22, in which the uphole target zone 22 is uphole of the downhole target zone 22. Subsequent to forming the downhole set of perforations 44 and prior to forming the uphole set of perforations 44, methods 500 may include translating the uphole sub-assembly uphole from the downhole target zone 22 to the uphole target zone 22 to form the uphole set of perforations 44.

In some examples, subsequent to the perforating at 530, methods 500 may include fracturing a target zone of the subsurface region of hydrocarbon well 50 at 532. Stated another way, and as illustrated in FIG. 1, methods 500 may include forming at least one fracture 60 that may extend from one or more perforations 44. The fracturing at 532 may include pumping a fracturing fluid 70 into target zone 22 of subsurface region 20 via the tubular conduit 42. Additionally or alternatively, the fracturing at 532 may include pumping fracturing fluid 70 into target zone 22 via the one or more perforations 44 formed during the perforating at 530.

For examples in which the fracturing at 532 includes forming at least one fracture 60 within the target zone 22 of subsurface region 20, methods 500 further may include propping the at least one fracture with a proppant 72. As an example, the proppant 72 may be entrained within fracturing fluid 70, and the propping may include flowing the proppant into the at least one fracture 60 via tubular conduit 42 and/or the one or more perforations 44.

The fracturing at 532 may be performed with any suitable timing and/or sequence within methods 500. As examples, the fracturing at 532 may be performed subsequent to the perforating at 530, prior to the retrieving at 535, and/or subsequent to the retrieving at 535. Stated another way, the fracturing may be performed while the uphole sub-assembly is positioned within the downhole tubular or while the uphole sub-assembly is not positioned within the downhole tubular.

Referring again to FIG. 4, methods 500 may include retrieving at 535. The retrieving at 535 may include retrieving the uphole sub-assembly to the surface region via the tubular conduit. Additionally or alternatively, the retrieving may include retrieving the downhole completion assembly to the surface region via the tubular conduit. With this in mind, the retrieving at 535 may include operatively translating the uphole sub-assembly and/or the downhole completion assembly in the uphole direction. Operatively translating the uphole sub-assembly and/or the downhole completion assembly in the uphole direction during the retrieving at 535 may be performed by substantially similar processes to the processes discussed herein with respect to the translating at 525.

The retrieving at 535 may be performed with any suitable timing and/or sequence within methods 500. As examples, the retrieving may be performed during the forming the fluid seal at 510, subsequent to the decoupling at 515, subsequent to the perforating at 530, and/or prior to the coupling at 555. When the retrieving includes retrieving the downhole completion assembly to the surface region, the retrieving may be performed subsequent to the coupling at 555 and/or subsequent to the ceasing at 560.

Figure 10:
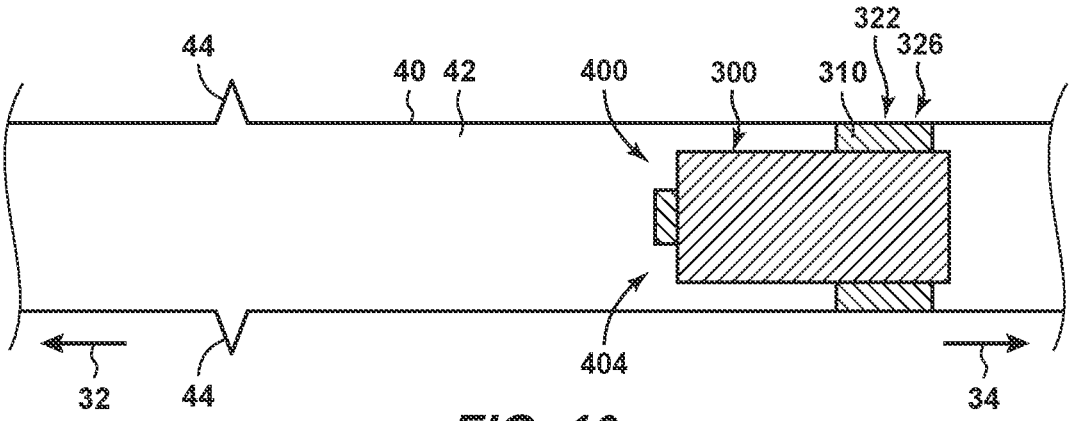
FIG. 10 is a schematic illustration of examples of a portion of the methods of FIG. 4.

FIG. 10 illustrates an example of the retrieving at 535. As demonstrated therein, downhole sub-assembly 300 may be in engaged state 326, and uphole sub-assembly 200 may be removed from downhole tubular 40 following the retrieving at 535.

Methods 500 further may include replenishing the downhole completion assembly, which may be performed subsequent to and/or as part of the retrieving at 535. In some examples, the replenishing may include replacing, or exchanging, one or more components, modules, devices, and/or subassemblies of the downhole completion assembly. For example, the replenishing may include replacing the perforation device of the uphole sub-assembly, replacing at least one shaped charge of the perforation device, and/or replacing the perforation device electrical conductor that extends between the uphole end of the perforation device and the downhole end of the perforation device.

In some examples, the replenishing may include replacing one or more components, modules, devices, and/or sub-assemblies of the downhole completion assembly that may have been exhausted, damaged, and/or rendered unusable during the completion operations. As discussed herein with reference to FIGS. 2 and 3, each component, module, device, and/or sub-assembly included in the downhole completion assembly may be configured to be replaced or exchanged without disassembling remainder of the downhole completion assembly. As such, the replenishing may include replacing one or more components, modules, devices, and/or sub-assemblies of the downhole completion assembly without disassembling any components, modules, devices, and/or sub-assemblies that are not being replaced.

Returning to FIG. 4, methods 500 include operatively translating the uphole sub-assembly in the downhole direction at 540. The translating at 540 may be performed with any suitable timing and/or sequence within methods 500. As examples, the translating at 540 may be performed subsequent to the perforating at 530, subsequent to the retrieving at 535, prior to the coupling at 555, and/or to facilitate the coupling at 555.

The translating at 540 may be performed to position the uphole sub-assembly proximate to downhole sub-assembly within the tubular conduit, such as to permit coupling of the uphole sub-assembly and the downhole sub-assembly. Additionally or alternatively, when methods 500 include retrieving the uphole sub-assembly at 535, the translating at 540 may be performed to translate uphole sub-assembly from the surface region to a desired, or selected, region within the tubular conduit, such as the target region and/or proximate to the downhole sub-assembly.

The translating at 540 may be performed in any suitable manner. As an example, the translating at 540 may include pumping a conveyance fluid into an uphole end region of the tubular conduit to flow the uphole sub-assembly in the downhole direction. Additionally or alternatively, the translating at 540 may include utilizing the conveyance module of the uphole sub-assembly to provide a motive force to operatively translate the uphole sub-assembly in the downhole direction.

Figure 11:
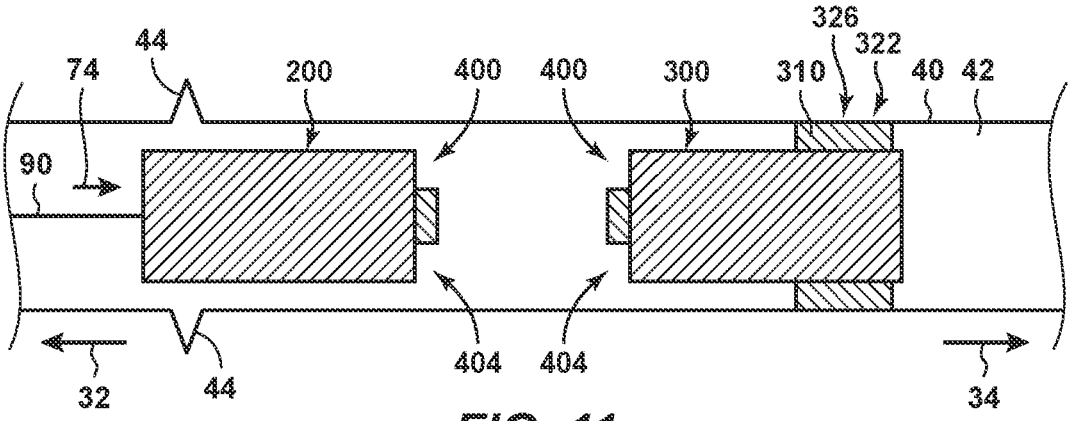
FIG. 11 is a schematic illustration of examples of a portion of the methods of FIG. 4.
Figure 12:
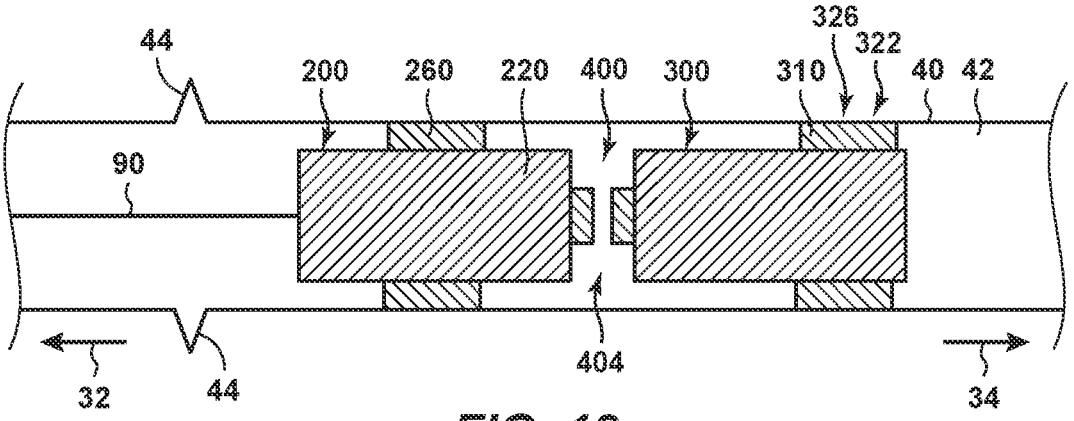
FIG. 12 is a schematic illustration of examples of a portion of the methods of FIG. 4.

FIGS. 11-12 illustrate examples of the translating at 540. As illustrated therein, downhole sub-assembly 300 may be in engaged state 326 and/or operatively engaged with downhole tubular 40, and coupler 400 may be in decoupled state 404 during the translating at 540. As illustrated in the example of FIG. 11, the translating 540 may include pumping conveyance fluid 74 into an uphole end region of tubular conduit 42 to flow uphole sub-assembly 200 in downhole direction 34. As illustrated in the example of FIG. 12, the translating at 540 additionally or alternatively may include utilizing conveyance module 260 to provide a motive force to operatively translate uphole sub-assembly 200 in downhole direction 34. More specifically, as discussed in more detail herein with reference to FIGS. 2 and 3, conveyance module 260 may operatively engage with downhole tubular 40 to operatively translate uphole sub-assembly 200 in downhole direction 34.

In some examples, the translating at 540 may utilize a combination of the conveyance fluid and the conveyance module to operatively translate the uphole sub-assembly in the downhole direction. As an example, the conveyance fluid may be utilized to operatively translate uphole sub-assembly 200 to and/or proximate perforations 44 that are uphole from downhole sub-assembly 300, as illustrated in FIG. 11. However, because downhole sub-assembly 300 forms fluid seal 322, the conveyance fluid may be incapable of translating the uphole sub-assembly all of the way into contact with the downhole sub-assembly. As such, the conveyance module may be utilized to further operatively translate the uphole sub-assembly in the downhole direction, as illustrated by the transition from FIG. 11 to FIG. 12.

As discussed herein with reference to FIG. 1, tubular conduit 42 may include debris 80 that may impede or inhibit translation of uphole sub-assembly 200 and/or downhole completion assembly 100 during one or more steps of methods 500. With this in mind, and turning back to FIG. 4, methods 500 may include cleaning the tubular conduit at 545. The cleaning the tubular conduit at 545 may be performed to move debris 80 from the path of, and/or that is proximate to, uphole sub-assembly 200 and/or downhole completion assembly 100 within tubular conduit 42, such as to permit and/or enhance operative translation thereof within tubular conduit 42.

The cleaning the tubular conduit at 545 may include agitating debris present within the tubular conduit with the cleaner module of the downhole completion assembly. Additionally or alternatively, the cleaning the tubular conduit at 545 may include pumping debris present within the tubular conduit with the pump module of the downhole completion assembly. As discussed herein with reference to FIGS. 2 and 3, cleaner module 240 and/or pump module 220 each may define portions of uphole sub-assembly 200.

In some examples, the cleaning the tubular conduit at 545 may include agitating the debris with the cleaner module, and pumping debris agitated by the cleaner module with the pump module. Thus, in such examples, the pumping may be performed substantially simultaneously with the cleaning, and/or subsequent to the agitating.

In other examples, the cleaning the tubular conduit at 545 may include either of the pumping and the agitating. Stated another way, in some examples, performing either of the pumping and the agitating may be sufficient to move the debris from the path of and/or proximate to the uphole sub-assembly and/or the downhole completion assembly, such that the other of the pumping and the cleaning is not needed.

As discussed herein, pumping the debris with the pump module may include pumping the debris toward the trailing end of the uphole sub-assembly and/or the downhole completion assembly, in which the trailing end corresponds to the downhole end during uphole translation and corresponds to the uphole end during downhole translation. Put differently, the pumping the debris may be performed during uphole and/or downhole translation of the uphole sub-assembly and/or the downhole completion assembly.

The pumping the debris may be performed with any suitable timing and/or sequence within methods 500. As examples, the cleaning at 545 may include at least one of pumping debris from proximate the downhole completion assembly, pumping the debris in the downhole direction during the operatively translating uphole sub-assembly in the uphole direction at 525, pumping debris in the downhole direction during the operatively translating the downhole completion assembly in the uphole direction at 565, and/or pumping debris in the in the uphole direction during the operatively translating the uphole sub-assembly in the downhole direction at 540.

Agitating the debris also may be performed with any suitable timing and/or sequence within methods 500. As examples, the cleaning at 545 may include at least one of agitating debris from proximate the downhole completion assembly, agitating the debris during the operatively translating the uphole sub-assembly in the uphole direction at 525, agitating debris during the operatively translating the downhole completion assembly in the uphole direction at 565, and/or agitating debris during the operatively translating the uphole sub-assembly in the downhole direction at 540. As a further example, the cleaning at 545 may be performed in conjunction with pumping conveyance fluid 74 within the wellbore, as these operations may displace debris out of the tubular conduit and into the subsurface region.

In some examples, debris may accumulate, and/or may be deposited, within the coupler of the downhole completion assembly during the completion operations. This may inhibit, or even preclude, the coupler from forming the couple between the uphole sub-assembly and downhole sub-assembly. As a more specific example, debris may accumulate within the coupler while the coupler is in the decoupled state and/or while the uphole and downhole sub-assemblies are physically separated during methods 500.

In view of the above, and referring to FIG. 4, methods 500 further may include cleaning the coupler at 550. Cleaning the coupler at 550 may be performed to displace, remove, substantially remove, and/or adequately remove debris that may be present within the coupler of the downhole completion assembly. Stated another way, cleaning the coupler may be performed to permit coupling of the uphole sub-assembly and the downhole sub-assembly at 555.

The cleaning the coupler at 550 may be performed with any suitable timing and/or sequence within methods 500. As examples, cleaning the coupler at 550 may be performed subsequent to the decoupling at 515, subsequent to the perforating at 530, subsequent to the operatively translating the uphole sub-assembly in the downhole direction at 540, at least partially concurrently with the operatively translating the uphole sub-assembly in the downhole direction at 540, prior to the coupling at 555, and/or at least partially concurrently with the coupling at 555.

The cleaning the coupler at 550 may be performed in any suitable manner. As an example, cleaning the coupler may include utilizing the pump module of the uphole sub-assembly to pump fluid in the direction of, through, and/or within the coupler such as to remove debris deposited therein.

FIG. 12 illustrates an example of the cleaning the coupler at 550. As shown, coupler 400 may be in decoupled state 404, and pump module 220 may be utilized to pump fluid at and/or within coupler 400 to remove debris deposited therein.

Turning back to FIG. 4, methods 500 further include coupling the uphole sub-assembly and the downhole sub-assembly at 555. The coupling at 555 may include engaging the uphole sub-assembly with the downhole sub-assembly. As a more specific example, the coupling at 555 may include coupling the uphole sub-assembly and the downhole sub-assembly to restrict relative motion along the length of the tubular conduit between the uphole sub-assembly and the downhole sub-assembly. Additionally or alternatively, the coupling at 555 may include coupling the uphole sub-assembly and the downhole sub-assembly to permit the operatively translating the downhole completion assembly in the uphole direction at 565.

The coupling at 555 may be performed with any suitable sequence and/or timing within methods 500. As examples, the coupling at 555 may be performed subsequent to the operatively translating the uphole sub-assembly in the downhole direction at 540 and/or prior to operatively translating the downhole completion assembly in the uphole direction at 565.

The coupling at 555 may be performed in any suitable manner. In some examples, the coupling at 555 may include transitioning coupler 400 from the decoupled state to the coupled state, in which the coupler may interlock the uphole sub-assembly and the downhole sub-assembly. As a more specific example, the coupling at 555 may include coupling the uphole and downhole portions of the coupler, such as described in more detail herein with reference to FIG. 2. The coupling at 555 also may include connecting electrical connectors of the coupler.

Figure 14:
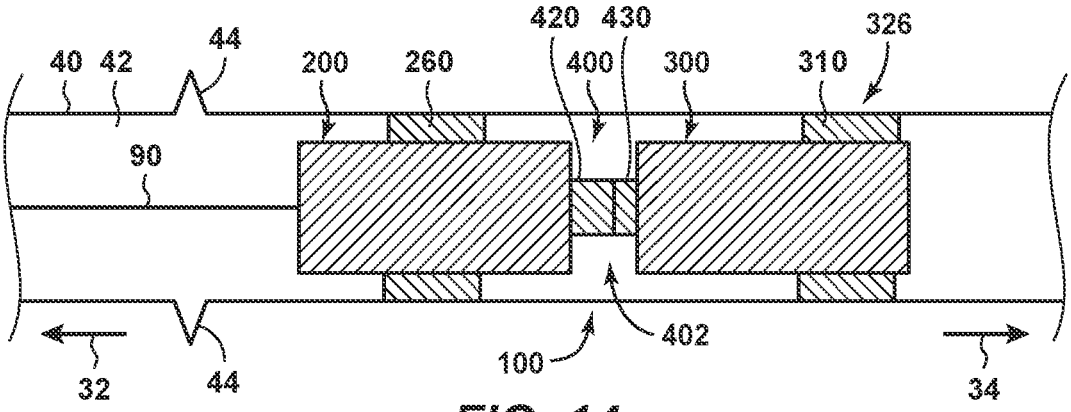
FIG. 14 is a schematic illustration of examples of a portion of the methods of FIG. 4.

FIG. 14 illustrates examples of the coupling at 555. As shown in FIG. 14, downhole sub-assembly 300 may be in engaged state 326, and conveyance module 260 of uphole sub-assembly 200 may be engaged with downhole tubular 40 during the coupling at 555. In the example shown, coupler 400 has been transitioned from the decoupled state to coupled state 402, such as to interlock uphole sub-assembly 200 and downhole sub-assembly 300. The coupling at 555 also may include coupling the uphole coupler portion 420 and the downhole coupler portion 430.

In some examples, it may not be possible to adequately perform the coupling at 555, for example, because obstructing debris is present within coupler 400 and/or one or more portions of coupler 400 were rendered damaged or inoperable during one or more preceding steps of methods 500. As such, methods 500 may include determining a success of the coupling at 555. Stated another way, methods 500 may include determining whether uphole sub-assembly 200 and downhole sub-assembly 300 are adequately coupled through coupler 400 subsequent to the coupling at 555. Determining the success of the coupling at 555 may be achieved in any suitable manner. For example, determining the success of the coupling at 555 may include measuring an electric current through the electrical connectors of coupler 400.

When methods 500 include the determining the coupling at 555 was unsuccessful, methods 500 may further include causing the downhole sub-assembly to self-destruct such as to remove downhole sub-assembly 300 from a target region of the downhole tubular. For example, when the coupling at 555 is determined to be unsuccessful, methods 500 may include wirelessly communicating a data signal to the communication module of the downhole sub-assembly that triggers self-destruction of the downhole sub-assembly. The data signal may be communicated through the downhole communication network, such as from the communication module of the uphole sub-assembly to the communication module of the downhole sub-assembly. Additionally or alternatively, the data signal may be communicated by transmitting a pressure pulse from the surface region and/or the uphole sub-assembly to the downhole sub-assembly. The data signal received by the downhole sub-assembly and/or the communication module thereof may trigger ceasing the fluid seal at 560, such as to cause downhole sub-assembly to fall or otherwise be displaced in the downhole direction within the tubular conduit.

When methods 500 include causing the downhole sub-assembly to self-destruct, methods 500 subsequently may include retrieving the uphole sub-assembly to the surface region, replacing the downhole sub-assembly with a new, or replacement, downhole sub-assembly, and/or operatively translating the downhole completion assembly in the downhole direction.

Figure 13:
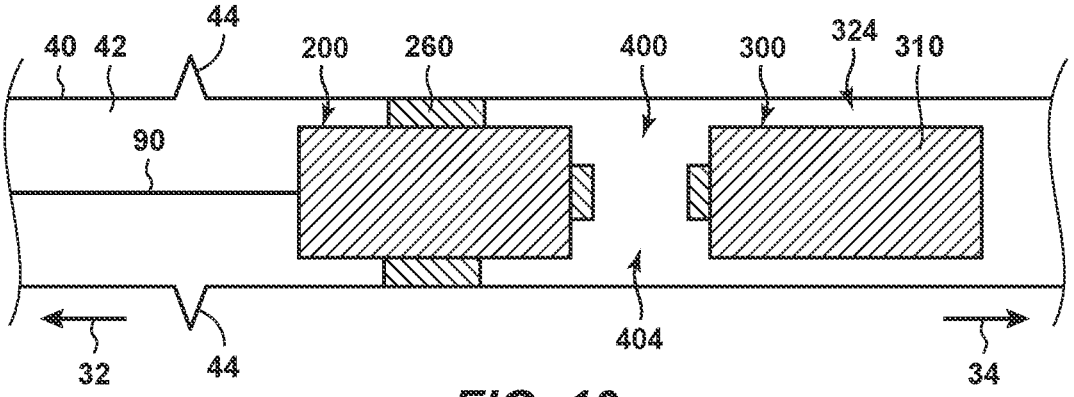
FIG. 13 is a schematic illustration of examples of a portion of the methods of FIG. 4.

FIG. 13 illustrates an example of the determining the coupling at 555 was unsuccessful. In the example shown, coupler 400 is in decoupled state 404, and downhole sub-assembly 300 has received a transition data signal causing sealing structure 310 to transition to the disengaged state 324 and causing downhole sub-assembly 300 to fall in downhole direction 34 within tubular conduit 42.

Referring again to FIG. 4, methods 500 include ceasing the fluid seal at 560. The ceasing the fluid seal at 560 may include transitioning the sealing structure of the downhole sub-assembly from the engaged state to the disengaged state. Stated another way, the ceasing the fluid seal at 560 may include operatively disengaging the sealing structure from the downhole tubular to permit motion of the downhole sub-assembly within the tubular conduit.

The ceasing the fluid seal at 560 may be performed with any suitable timing and/or sequence within methods 500. As an example, the ceasing the fluid seal at 560 may be performed subsequent to the coupling at 555. In such examples, the ceasing the fluid seal at 560 may be performed to permit the translating the downhole completion assembly in the uphole direction at 565. As another example, the ceasing the fluid seal at 560 may be performed prior to the coupling at 555, such as part of causing self-destruction of the downhole sub-assembly when the coupling at 555 is unsuccessful.

Figure 15:
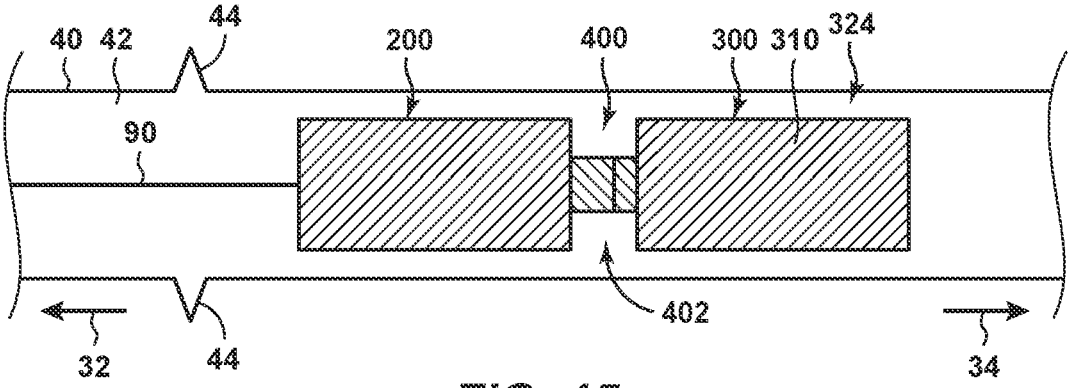
FIG. 15 is a schematic illustration of examples of a portion of the methods of FIG. 4.

FIG. 15 illustrates an example of the ceasing the fluid seal at 560. As shown in this example, coupler 400 is in coupled state 402 and interlocks uphole sub-assembly 200 and downhole sub-assembly 300. As further shown, sealing structure 310 of downhole sub-assembly is in disengaged state 324, such as to permit translation of downhole completion assembly 100 along the length of tubular conduit 42.

Referring again to FIG. 4, methods 500 include translating the downhole completion assembly in the uphole direction at 565. The translating at 565 may be performed to reposition the downhole completion assembly within the tubular conduit. For example, methods 500 may include positioning the downhole completion assembly in a downhole-most target region of the downhole tubular during the positioning at 505, forming the fluid seal with the downhole sub-assembly therein at 510, and perforating a downhole-most target zone of the downhole tubular at 530. In such examples, it may be desirable to perforate a second target zone and/or a plurality of target zones that are uphole from the downhole-most target zone without removing the downhole sub-assembly and/or the downhole completion assembly from the tubular conduit. With this in mind, the translating at 565 may be performed to position the downhole completion assembly and/or the downhole sub-assembly within the second target region, and/or an uphole target region such as to permit perforation of the second and/or uphole target zone.

Additionally or alternatively, when it is desirable to replenish one or more components, modules, devices, and/or sub-assemblies of the downhole completion assembly and/or the downhole sub-assembly following the perforating at 530 and/or the ceasing at 560, the translating at 565 may be performed as a part of the retrieving at 535.

The translating at 565 may be performed in any suitable manner. As examples, the translating at 565 may include utilizing the conveyance module of the downhole completion assembly to provide a motive force to operatively translate the downhole completion assembly in the uphole direction. Additionally or alternatively, the translating at 565 may include utilizing the umbilical to pull the downhole completion assembly in the uphole direction.

The translating at 565 may be performed with any suitable timing and/or sequence within methods 500. As examples, the translating at 565 may be performed subsequent to the coupling at 555 and/or subsequent to the ceasing at 560.

Figure 16:
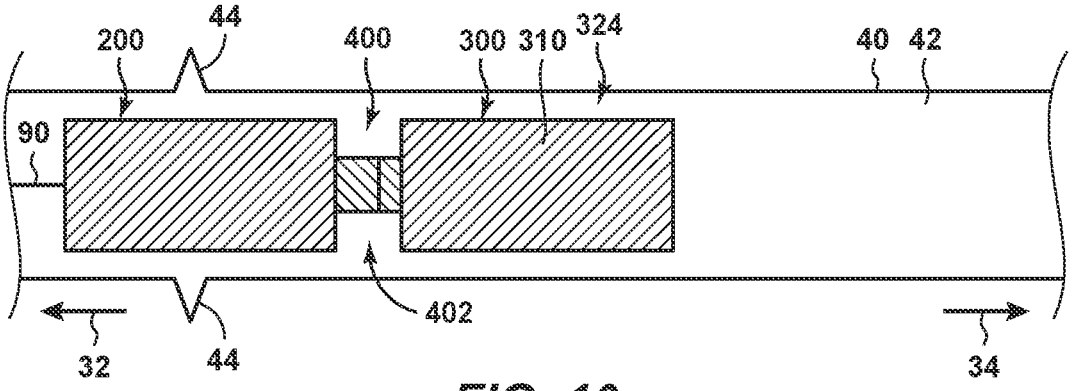
FIG. 16 is a schematic illustration of examples of a portion of the methods of FIG. 4.

FIG. 16 illustrates an example of the translating at 565. As shown, coupler 400 may be in coupled state 402, and sealing structure 310 may be in disengaged state 324, such as to permit translation of downhole completion assembly 100 in uphole direction 32. Further shown, uphole sub-assembly may be operatively attached to umbilical 90, and umbilical 90 may be utilized to pull downhole completion assembly 100 in uphole direction 32.

Referring again to FIG. 4, methods 500 may include repeating at 570. The repeating at 570, when performed, may include repeating any suitable portion, fraction, and/or subset of methods 500 in any suitable order. In some examples, the repeating at 570 may include repeating a single step of methods 500 one or more times, or repeating any set of steps of methods 500 one or more times before proceeding to a subsequent step. Additionally or alternatively, the repeating at 570 may include repeating all of methods 500 any number of times, such as to selectively perforate a plurality of spaced apart-regions of the downhole tubular.

For example, performing methods 500 a first time may include perforating a first region within the downhole tubular that may define a downhole-most region of the downhole tubular or a downhole-most perforated region of the downhole tubular. Repeating methods 500 may include perforating a second region within the downhole tubular that is uphole of the downhole-most region of the downhole tubular, and repeating methods 500 a second time may include perforating a third region within the downhole tubular that is uphole of the second region. Stated more generally, repeating methods 500 one or more times may include perforating a plurality of spaced-apart regions of the downhole tubular, in which each region is uphole from a previously perforated region. This may include repeating utilizing a single downhole sub-assembly and/or repeating without leaving a plurality of plugs within the tubular conduit.

The repeating at 570 may include repeating a subset of steps of methods 500. For example, methods 500 may include the positioning at 505, followed by the forming the fluid seal at 510, followed by the decoupling at 515, followed by the translating at 525, followed by the perforating at 540. In such examples, the repeating at 570 may include repeating the translating at 525, followed by repeating the perforating at 530, any suitable number of times, such as to perforate any suitable number of spaced-apart regions of the downhole tubular, without ceasing the fluid seal at 560.

In some examples, during the repeating at 570, methods 500 may include repeating the coupling and determining the repeating the coupling as unsuccessful. In such examples, the repeating at 570 may include causing the downhole sub-assembly to self-destruct, such as discussed in more detail herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas, well drilling, and/or well completion industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of completing a hydrocarbon well, the method comprising:

positioning a downhole completion assembly within a target region of a tubular conduit of a downhole tubular that extends within a wellbore of the hydrocarbon well, wherein the downhole completion assembly includes an uphole sub-assembly that defines an uphole end of the downhole completion assembly, and a downhole sub-assembly that defines a downhole end of the downhole completion assembly;

forming a fluid seal within the tubular conduit with a sealing structure of the downhole sub-assembly;

decoupling the uphole sub-assembly from the downhole sub-assembly;

operatively translating the uphole sub-assembly in an uphole direction within the tubular conduit;

perforating the downhole tubular with a perforation device of the uphole sub-assembly;

operatively translating the uphole sub-assembly in a downhole direction within the tubular conduit;

coupling the uphole sub-assembly to the downhole sub-assembly;

ceasing the fluid seal; and operatively translating the downhole completion assembly in the uphole direction within the tubular conduit.

2. The method of claim 1, wherein subsequent to the perforating, the method further includes fracturing a target zone of a subsurface region that defines the wellbore.

3. The method of claim 1, wherein the method further includes retrieving the uphole sub-assembly to a surface region via the tubular conduit, wherein the method includes performing the retrieving at least one of:

(i) during the forming the fluid seal with the downhole sub-assembly;

(ii) subsequent to the decoupling;

(iii) subsequent to the perforating; and (iv) prior to the coupling.

4. The method of claim 3 wherein the method further includes replenishing the uphole sub-assembly, wherein the replenishing is subsequent to the retrieving, and further wherein the replenishing includes at least one of:

(i) replacing at least one shaped charge of the perforation device;

(ii) replacing the perforation device;

(iii) replacing at least one component of the uphole sub-assembly; and (iv) replacing a perforation device electrical conductor that extends between an uphole end of the perforation device and a downhole end of the perforation device.

5. The method of claim 1, wherein the method further includes pumping debris, which is present within the tubular conduit, with a pump module of the downhole completion assembly, wherein at least one of:

(i) during the operatively translating the uphole sub-assembly in the uphole direction, the pumping the debris includes pumping the debris in the downhole direction;

(ii) during the operatively translating the downhole completion assembly in the uphole direction, the pumping the debris includes pumping the debris in the downhole direction;

(iii) during the operatively translating the uphole sub-assembly in the downhole direction, the pumping the debris includes pumping the debris in the uphole direction; and (iv) the pumping the debris includes pumping the debris from proximate the downhole completion assembly.

6. The method of claim 1, wherein the method further includes agitating debris, which is present within the tubular conduit, with a cleaner module of the downhole completion assembly, wherein the method includes performing the agitating at least one of:

(i) during the operatively translating the uphole sub-assembly in the uphole direction;

(ii) during the operatively translating the downhole completion assembly in the uphole direction;

(iii) during the operatively translating the uphole sub-assembly in the downhole direction; and (iv) to move the debris from proximate the downhole completion assembly.

7. The method of claim 1, wherein the sealing structure defines a disengaged state, in which the sealing structure is free to move within the tubular conduit, and an engaged state, in which the sealing structure operatively engages the downhole tubular and forms the fluid seal with the tubular conduit, wherein the forming the fluid seal includes transitioning the sealing structure from the disengaged state to the engaged state, and further wherein the ceasing the fluid seal includes at least one of:

(i) transitioning the sealing structure from the engaged state to the disengaged state; and (ii) destroying the downhole sub-assembly.

8. The method of claim 1, wherein subsequent to the forming the fluid seal, the method further includes maintaining the fluid seal at least one of:

(i) during the decoupling;

(ii) during the operatively translating the uphole sub-assembly in the uphole direction;

(iii) during the perforating;

(iv) during the operatively translating the uphole sub-assembly in the downhole direction; and (v) during the coupling.

9. The method of claim 1, wherein the downhole completion assembly further includes a coupler configured to selectively and operatively couple the uphole sub-assembly and the downhole sub-assembly to one another, wherein the coupler defines a coupled state, in which the coupler operatively interlocks the uphole sub-assembly and the downhole sub-assembly to one another, and a decoupled state, in which the coupler permits relative motion between the uphole sub-assembly and the downhole sub-assembly, wherein the decoupling includes transitioning the coupler from the coupled state to the decoupled state, and further wherein the coupling includes transitioning the coupler from the decoupled state to the coupled state.

10. The method of claim 9, wherein the coupler includes an electrical connector configured to convey an electric current between the uphole sub-assembly and the downhole sub-assembly.

11. The method of claim 10, wherein the electrical connector includes an electrical power connector, and further wherein at least one of:

(i) prior to the decoupling, the method further includes powering the downhole sub-assembly via the electrical power connector; and (ii) subsequent to the coupling, the method further includes powering the downhole sub-assembly via the electrical power connector.

12. The method of claim 10, wherein the electrical connector includes an electrical data connector, and further wherein at least one of:

(i) prior to the decoupling, the method further includes communicating a data signal between the uphole sub-assembly and the downhole sub-assembly via the electrical data connector; and (ii) subsequent to the coupling, the method further includes communicating the data signal between the uphole sub-assembly and the downhole sub-assembly via the electrical data connector.

13. The method of claim 12, wherein the communicating the data signal includes communicating at least one of:

(i) a seal integrity of the sealing structure;

(ii) a seal status of the sealing structure;

(iii) a power status of the downhole sub-assembly; and (iv) a coupling status between the uphole sub-assembly and the downhole sub-assembly.

14. The method of claim 1, wherein the method further includes cleaning the coupler, wherein the method includes performing the cleaning the coupler at least one of:

(i) subsequent to the decoupling;

(ii) subsequent to the perforating;

(iii) subsequent to the operatively translating the uphole sub-assembly in the downhole direction;

(iv) at least partially concurrently with the operatively translating the uphole sub-assembly in the downhole direction;

(v) prior to the coupling; and (vi) at least partially concurrently with the coupling.

15. The method of claim 1, wherein the method includes repeating the method a plurality of times to selectively perforate a plurality of spaced-apart regions of the downhole tubular, wherein the repeating includes repeating such that each region in the plurality of spaced-apart regions of the downhole tubular is uphole from a previously perforated region in the plurality of spaced-apart regions of the downhole tubular.

* * * * *